US007907885B2

(12) United States Patent
Thayer

(10) Patent No.: US 7,907,885 B2
(45) Date of Patent: Mar. 15, 2011

(54) ELECTROSTATIC ROLL CLEANER

(75) Inventor: Bruce E Thayer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 166 days.

(21) Appl. No.: 12/336,791

(22) Filed: Dec. 17, 2008

(65) Prior Publication Data

US 2010/0150629 A1 Jun. 17, 2010

(51) Int. Cl.
*G03G 21/00* (2006.01)

(52) U.S. Cl. ..... 399/357

(58) Field of Classification Search ..... 399/343, 399/352, 353, 354, 357
See application file for complete search history.

(56) References Cited

U.S. PATENT DOCUMENTS

| | | | | |
|---|---|---|---|---|
| 4,398,820 | A | 8/1983 | Thayer | |
| 7,108,020 | B2 * | 9/2006 | Stone | 139/383 A |
| 2007/0292178 | A1 | 12/2007 | Iwasaki | |
| 2008/0089715 | A1 | 4/2008 | Denton | |
| 2008/0101834 | A1 * | 5/2008 | Iwasaki | 399/357 |

* cited by examiner

*Primary Examiner* — Sandra L Brase
(74) *Attorney, Agent, or Firm* — Ronald E. Prass, Jr.; Prass LLP

(57) ABSTRACT

A cleaning roll for a xerographic cleaning station is disclosed. The roll may comprise a compliant foam layer covered with a fabric overcoating. The cleaning station may also contain a detoning roll which contacts the cleaning roll to attract residual toner for disposal out of the station. There may be an electrical connection in the station to a biasing structure which will bias both the fabric overcoating and the detoning roll. The conductive fabric may have an average roughness (RA) not exceeding about 8 μm to 10 μm and the fabric comprises yarns of similar size to provide thereby a smooth and uniform surface texture.

14 Claims, 4 Drawing Sheets

| | |
|---|---|
| A | CHARGING STATION |
| B | EXPOSURE STATION |
| C | DEVELOPMENT STATION |
| D | TRANSFER STATION |
| E | DETACK STATION |
| F | FUSING STATION |
| G | CLEANING STATION |

| | |
|---|---|
| A | CHARGING STATION |
| B | EXPOSURE STATION |
| C | DEVELOPMENT STATION |
| D | TRANSFER STATION |
| E | DETACK STATION |
| F | FUSING STATION |
| G | CLEANING STATION |

ELECTROSTATIC ROLL CLEANER

This invention relates to an electrophotographic process and, more specifically, to a cleaning system useful in said process.

BACKGROUND

By way of background in xerography or an electrostatographic process, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner is electrostatically attached to the latent electrostatic image areas to create a visible replica of the original. The developed image is then usually transferred from the photoreceptor surface to a final support material such as paper, and the toner image is fixed thereto to form a permanent record corresponding to the original.

In some xerographic copiers or printers, a photoreceptor surface is generally arranged to move in an endless path through the various processing stations of the xerographic process. Since the photoreceptor surface is reusable, the toner image is then transferred to a final support material, such as paper, and the surface of the photoreceptor is prepared to be used once again for the reproduction of a copy of an original. In this endless path, several xerographic related stations are traversed by the photoconductive belt.

Generally, after the transfer station, a photoconductor cleaning station is next and it comprises an endless photoconduction belt which passes sequentially to a first cleaning brush, often a second cleaning brush and after the brushes are positioned, a spots blade which is used to remove residual debris from the belt, such as toner additive and other filming. A problem is that the good cleaning efficiency of the cleaner brushes leaves a minimal amount of toner on the photoconductor and the spots blade is therefore inadequately lubricated.

One widely accepted prior art method of cleaning residual toner from the surface of a photoreceptor of a typical copier or printer is by means of a cylindrical brush or brushes rotated in contact with the photoreceptor surface at a relatively high rate of speed. Generally, rotatable brushes are mounted in interference contact to the photoreceptor surface to be cleaned, and the brushes are rotated so that the brush fibers continually wipe across the photoreceptor. Electrical bias applied to conductive brush fibers aids in removing and transporting cleaned material away from the photoreceptor surface. In order to reduce the dirt level within the brush, a flicker bar and vacuum system may be provided which removes some residual toner and toner agents from the brush fibers and exhausts some of the residual toner and toner agents from the cleaner. Alternatively, toner may be cleaned from the brush fibers by electrostatic transfer to electrically biased detoning rolls. Charged toner particles are transferred from the brush fiber tips to the detoning roll surface electrically biased to the opposite polarity of the toner charge. The toner cleaned from the cleaning blade is then removed from the detoning roll by a scraper blade. Unfortunately, the brush could become contaminated with toner and toner agents and, after extended usage, needs to be frequently replaced. Brush life is ultimately compromised by toner and additive impaction on fiber ends that affects conductivity and physical changes to brush through mechanical or electrical breakdown that affect the mechanical integrity and/or electrical conductivity. With increased processing speeds of today's copiers and printers and the expanded use of toner agents, the foregoing brush cleaning techniques are not totally effective or practical.

Electrostatic brush (ESB) cleaning has been long the choice for high volume cleaning applications. ESB cleaning provides superior reliability when compared to blade cleaning but at much higher unit manufacturing cost (UMC). Air detoning prevents the build up of toner within the brush but requires an expensive and high power usage air and filtration system to remove cleaned toner from the detoning air stream. Electrostatic detoning of ESB cleaners is lower cost than air detoning but the brushes must be periodically vacuumed or replaced to prevent print defects when toner build up within the brush falls out.

ESB cleaners are limited in their cleaning capacity by the density of fibers on the brush and photoreceptor drag and wear caused by the brush pile. Smaller brush fiber diameters allow greater fiber densities for greater cleaning capacity and can reduce the stiffness of the brush pile. There is, however, a practical limit to the reduction of brush fiber diameter. Experience has shown that brush stiffness can be reduced with very small fiber diameters, but photoreceptor wear increases when compared to larger fibers. The explanation is that electric discharges from the smaller fiber tips generate erosion of the photoreceptor surface. The minimum brush fiber diameter limitation creates an ESB cleaning capacity limit.

The present invention provides an electrostatic roll cleaner and a cleaning station whereby the roll cleaner comprises a compliant foam underlayer having a coating thereon of a conductive woven, non-woven, braided or knit fabric. The cleaning station is in electrical contact with a biasing structure. This structure is configured to bias the fabric relative to the photoreceptor ground surface from +50 to +500 volts to clean negatively charged toner and from −50 to −500 volts to clean positively charged toner.

Since most toners used today are negatively charged, the embodiments throughout this disclosure and claims will be described relating to the use of a negative polarity toner; however, when a positive polarity toner is used, the proper opposite polarity adjustments can easily be made, such as biasing of the detoning roll and biasing of the conductive fabric, as will be described below.

While the cleaner roll of this invention is described herein in reference to cleaning a photoreceptor surface, it can also be used in other xerographic stations such as a cleaner in an intermediate transfer belt, biased transfer roll, biased transfer belt, or fuser station. Similarly, the cleaner roll fabric covering of this invention is described herein as conductive. The cleaner roll fabric covering can also be non-conductive. If the cleaner roll fabric covering is non-conductive, the fabric material will be chosen to tribocharge against the contacting surfaces such that the appropriate electrical potential for cleaning and detoning is generated on the surface of the fabric. Because the cleaner roll fabric covering is non-conductive, the detoning roll surface need not be a dielectric, e.g., the anodized aluminum surface used with conductive rolls, but could be a simple conductive surface, e.g., stainless steel. Because of variations caused by environmental temperature and humidity and contamination of contacting surfaces, generation of cleaning electrical biases through tribocharging is less predictable than direct biasing of conductive fabrics with a voltage source. For these reasons direct biasing of conductive fabric electrostatic rolls is preferred.

SUMMARY

In the present invention electrostatic cleaning and detoning are performed by a biased conductive fabric supported by a compliant substrate (e.g. foam) rather than by the tips of conductive fibers. The conductive fabric, either woven, non-woven, braided or knit, can greatly increase the surface area for cleaning when compared to a fiber brush. It is important for best results that the yarns in the conductive fabric are of similar size so that the surface of the fabric has a smooth uniform texture. By similar size is meant not varying in size by more than +/−20%. Except for the use of a conductive fiber, in one embodiment the cleaning mechanism of electrostatic roll cleaning is similar to electrostatic brush cleaning as described in U.S. Pat. No. 4,398,820. In the present invention, toner particles are mechanically dislodged from the photoreceptor surface by fibers bundled into yarn within the fabric and then electrostatically adhered to the biased conductive fibers for transport away from the photoreceptor surface. Electrostatic detoning of the fabric occurs when the roll is rotated against a biased detoning roll of the type used in ESB cleaners. The fabric covered roll is advantaged in electrostatic detoning over a brush because it doesn't have the pile depth of the brush where toner can accumulate. Detoning efficiency will be higher and toner drop out will be eliminated because toner cannot accumulate in the fabric.

The electrostatic roll (ESR) cleaner consists of a biased conductive fabric covered foam roll mounted on a rigid shaft. As noted, except for the use of a conductive fabric and specific biasing of the fabric, it operates similar to an electrostatic brush (ESB) cleaner with electrostatic detoning. A preclean charging (PCC) device is required to adjust toner charge so that it can be cleaned efficiently by the biased electrostatic roll. FIG. 2 shows the components of the present ESR cleaner.

The conductive fabric can be fabricated from a number of different conductive fibers. Some commercially available conductive fibers and fabrics are listed below in Table 1. The fabric can be made entirely from conductive fiber yarns or the fabric can be a mixture of conducting and non-conducting yarns. The fabric can be woven, non-woven, braided or knit. The design of the fabric (e.g. weave pattern) would be optimized to provide efficient cleaning of toner, additives, and other debris. The conductive fabric can be designed to provide a desired surface texture. Fiber selection would be based on cost, brush life (e.g. resistance to wear) and cleaning surface abrasion. ESB cleaners are known to be relatively gentle to the surface being cleaned. This has resulted in the need to provide spots blades in ESB systems to remove large, well adhered particles and to suppress films. An electrostatic roll cleaner has more latitude in design of the conductive fabric than the design latitude for an electrostatic brush in providing a desirable level of surface abrasion to prevent spots and films.

TABLE 1

Examples of Commercially Available Conductive Fibers and Fabrics:

| CONDUCTIVE FIBERS | CONDUCTIVE FABRICS |
|---|---|
| Stainless steel | Copper coated nylon fabric |
| Silver coated nylon core | Nickel and copper coated polyester fabric |
| Nickel coated polyester core | Nickel and copper coated nylon fabric |
| Carbon loaded nylon over nylon core | Copper and tin coated nylon fabric |
| Nickel and copper coated nylon | |
| Nickel, copper, nickel Ni-Cobalt alloy coated polyester | |
| Carbon loaded acrylic | |
| Carbon loaded nylon coated nylon core | |
| Carbon loaded polyester extruded through polyester core | |

Electrostatic rolls can be made at costs comparable to or lower than the cost of electrostatic brushes. Foam layers or rolls used in the present invention are low cost components. The conductive fabric covering can also be low cost relative to the cost of conductive brush pile. Table 2 lists conductive fabric material costs for an example electrostatic roll. The conductive fabrics are commercially available. In production the woven, non-woven, braided or knit conductive fabric coverings could be fabricated as tubes. The tube would then be slid over and adhered to a foam roll core. Fabrication of an electrostatic roll would be easier than fabrication of an electrostatic brush. In a brush, a pile strip is woven on a backing fabric strip. The strip is wound on and glued to a brush core and then sheared to size in a fixture. An electrostatic roll diameter is controlled by the size of the conductive fabric sleeve. The foam roll core diameter is not of interest in determining the roll diameter. The foam roll diameter will impact the stiffness of the roll but within typical foam roll diameter tolerances the roll stiffness variation would not be large.

TABLE 2

Examples of Electrostatic Roll Covering Costs from Commercially Available Conductive Fabrics

| CONDUCTIVE FABRIC | DESCRIPTION | FABRIC $/BRUSH |
|---|---|---|
| Knit stainless steel mesh | Knit stainless steel | High price |
| See-thru | Knit silver coated nylon | Low price |
| Nickel Mesh | Woven nickel coated polyester | Low price |
| Flectron | Woven rip-stop nylon substrate plated with copper | Medium price |
| Flectron-N | Woven polyester plated with nickel and copper | Medium price |
| Hi-Performance | Knit 20 denier trilobal nylon silver coated | Low price |
| Zelt | Woven nylon substrate plated with copper and and tin | Medium price |
| VeilShield | Woven 132/inch polyester coated with blackened copper | Medium price |
| CobalTex | Woven nickel, copper, nickel, Ni-Cobalt alloy coated polyester | High price |

The electrostatic roll has the potential of a much larger cleaning capacity than an electrostatic brush. This is because the surface area of the fabric is far greater than the surface area of the brush tips. Using a cleaning capacity model to compare the electrostatic brush cleaning ESB to a plain weave CobalTex ESR of the same diameter and speed, a 20 times increase in cleaning capacity was predicted. The comparison assumed the same toner thickness calculated by the model for the toner attached to the brush fiber tips. Only half of the conductive fabric surface area was considered functional (assumption: warp cleans and weft does not). Even if the assumptions used in this projection are wildly optimistic, the cleaning capacity of the electrostatic roll ESR is still likely to be much greater than that of an ESB. The large cleaning capacity of an ESR provides the capability of cleaning both toner and toner additives better than an ESB.

The very shallow depth of the ESR fabric surface when compared to an ESB pile results in more efficient electrostatic detoning. Electrostatic detoning of brush fibers is only effective for a short distance from the fiber tip. Toner that migrates below the effective detoning depth accumulates along the fiber shaft and at the core of the brush. Over time detoning inefficiencies result in the build up of significant quantities of toner within the void volume of the brush. At some point the collected toner becomes unstable and can fall out of the brush when disturbed by machine vibrations, brush start-up, etc.

Depending on the machine architecture, the toner can fall out of the brush directly onto the paper paths or prints. At the least, toner falling out of the cleaner creates contamination that can generate early failure of other components and create dirty conditions for the tech rep and customer. The ESR conductive fabric will be more efficiently detoned because toner is close to the detoning roll. The higher detoning efficiency results in less accumulation of toner in the fabric. Also, the fabric itself is not capable of holding anywhere near the quantities of toner that a brush can accumulate. Even if toner drops out of the conductive fabric covering of an ESR, the amount of toner released will be small enough to create little or no problem.

U.S. Pat. No. 4,398,820 describes a smooth biased roll cleaner. This cleaner was essentially the electrostatic detoning roll from a magnetic brush cleaner applied directly to a belt photoreceptor. The hard anodized cleaning roll was then cleaned with a steel shim blade. This cleaner was not successful because the smooth, large diameter cleaning roll did not generate high enough electric fields to efficiently remove toner from the surface of the photoreceptor. In the present invention, the ESR fabric texture contains small diameter conductive fibers that provide high electric fields to attract and hold detached toner and toner additive particles from the photoreceptor surface. The conductive fibers do not need to be as small as required in an ESB to obtain high toner cleaning capacity. This avoids the photoreceptor "scratching" problems experienced when very small brush fibers were used. The small fiber tips generated electric discharges that weakened the photoreceptor surface and resulted in photoreceptor erosion. Preliminary testing of the ESR concept indicates that larger conductive fibers may be desirable to provide a deeper texture to the fabric surface.

Experiments have been performed to demonstrate the cleaning function of a biased conductive fabric. In these tests a conductive fabric was mounted on a foam pad. The fabric-pad assembly was then mounted to the bottom of a rigid piece of plastic with a 25 g weight mounted above the fabric-pad on the top side of the plastic. Toner was developed onto a single component photoreceptor drum. The weighted conductive fabric pad was then pulled across the photoreceptor surface with a range of electrical biases. The first test was with the fabric and photoreceptor substrate at the same potential, i.e. no electric field between the two. In this case some toner was mechanically removed from the photoreceptor and transferred to the fabric.

The second test had the fabric biased 300 v more positive than the photoreceptor substrate. The majority of toner in contact with the fabric was removed from the photoreceptor. The last test biased the fabric 300 v more negative than the photoreceptor substrate. In this case toner was smeared by the fabric but very little toner was transferred from the photoreceptor to the fabric. These tests demonstrate that a biased conductive fabric of the present invention is capable of cleaning toner from the surface of a photoreceptor. See FIG. 3 in description of Drawing. FIG. 3 Electrostatic roll cleaning demonstration tests at three cleaning biases. Following the cleaning tests described above, electrostatic detoning of the positive biased fabric pad (that did a good job of cleaning) was attempted. The toner laden fabric pad was wiped across the surface of an anodized electrostatic detoning roll at the same three bias conditions used for the cleaning experiments. With no electric field between the conductive fabric and the electrostatic detoning roll core, very little toner was transferred to the surface of the detoning roll. Less toner was transferred to the detoning roll when the detoning roll was biased 300 v more negative than the conductive fabric. A large amount of the toner on the conductive fabric was transferred to the detoning roll when the detoning roll was biased 300 v more positive than the conductive fabric. See FIG. 3.

DETAILED DISCUSSION OF DRAWINGS AND PREFERRED EMBODIMENTS

Figure 1A:
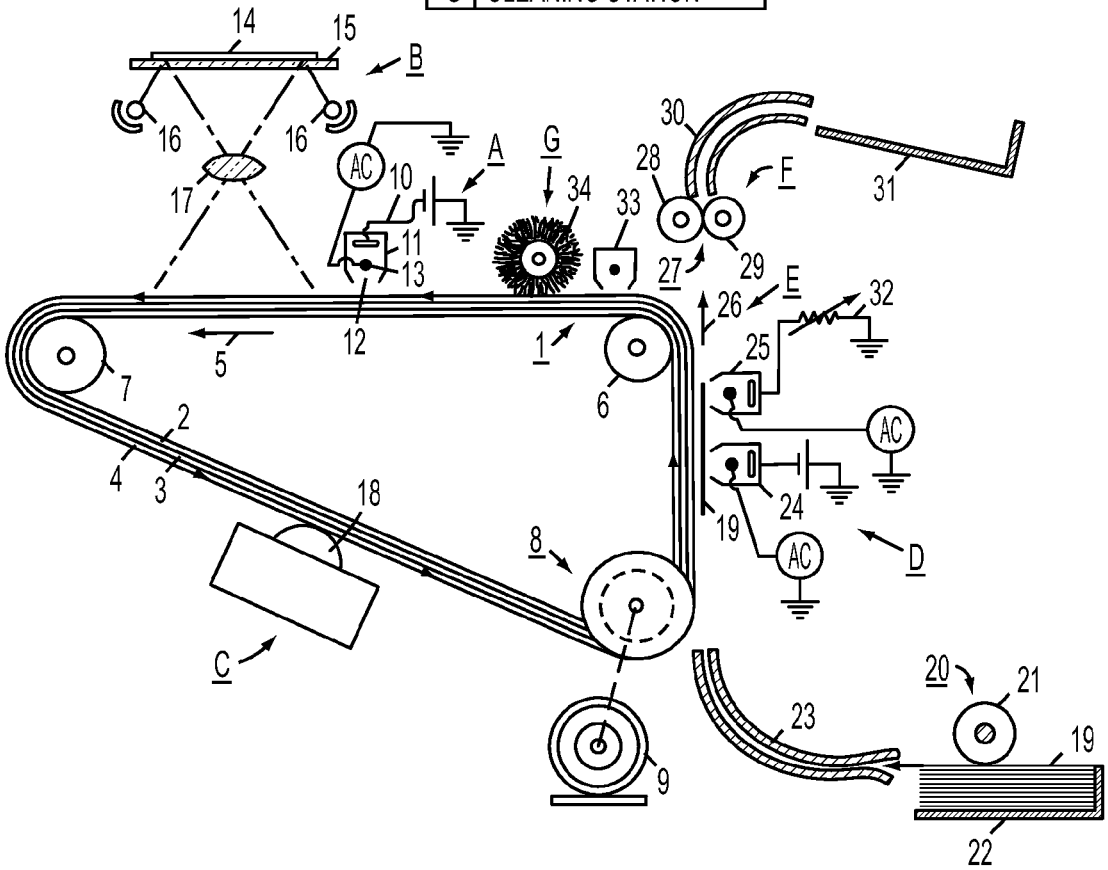
FIG. 1A PRIOR ART
FIG. 1A is a diagram of a complete prior art xerographic marking system.
Figure 1B:
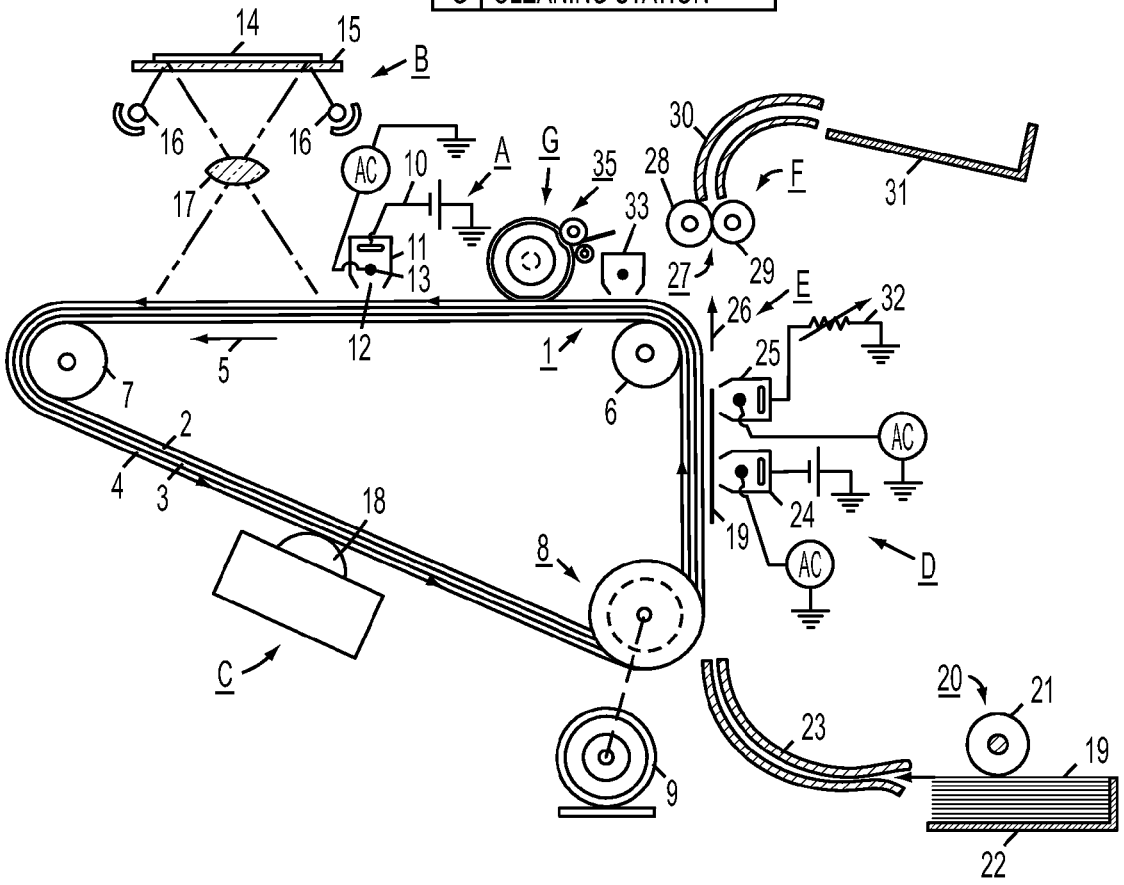
FIG. 1B is a xerographic marking system using the roll cleaner 35 of the present invention shown in FIG. 2.

In FIG. 1A, typical xerographic marking system is shown as used in the prior art. Substituting the electrostatic roll cleaner 35 of the present invention for brush cleaner 34 shown in FIG. 1 would provide the entire xerographic marking system of the present invention. In FIGS. 1A and 1B the following numbered and lettered designations are presented:

1. Photoconductive belt
2. Electrically conductive substrate
3. Charge generator layer
4. Charge transport layer
5. Directional arrow
6. Stripping roller
7. Tension roller
8. Drive roller
9. Motor
10. Corona device
11. Conductive shield
12. Dicorotron electrode comprised of elongated bare wire
13. Electrically insulating layer
14. Original document
15. Transparent platen
16. Lamps
17. Lens
18. Magnetic brush developer roller
19. Sheet of support material
20. Sheet feeding apparatus
21. Feed roll
22. Stack
23. Chute
24. Corona generating device
25. Detack corona generating device
26. Directional arrow
27. Fuser assembly
28. Heated fuser roller
29. Backup roller
30. Fusing sheet guide
31. Catch tray
32. Resistor
33. Shield circuit of a preclean dicorotron
34. Conventional cleaning brush
35. Electrostatic roller cleaner of this invention The "conventional stations" in a xerographic marking system comprises as shown in FIGS. 1A and 1B the following stations:

A. Charging Station
B. Exposure station
C. Development Station
D. Transfer station E. Detack station F. Fusing station G. Cleaning station As above noted, removing prior art brush cleaning apparatus and replacing it with the electrostatic roll cleaner 35 of the present invention will result in a complete marking system using the roll cleaner 35 of the present invention.

Figure 2:
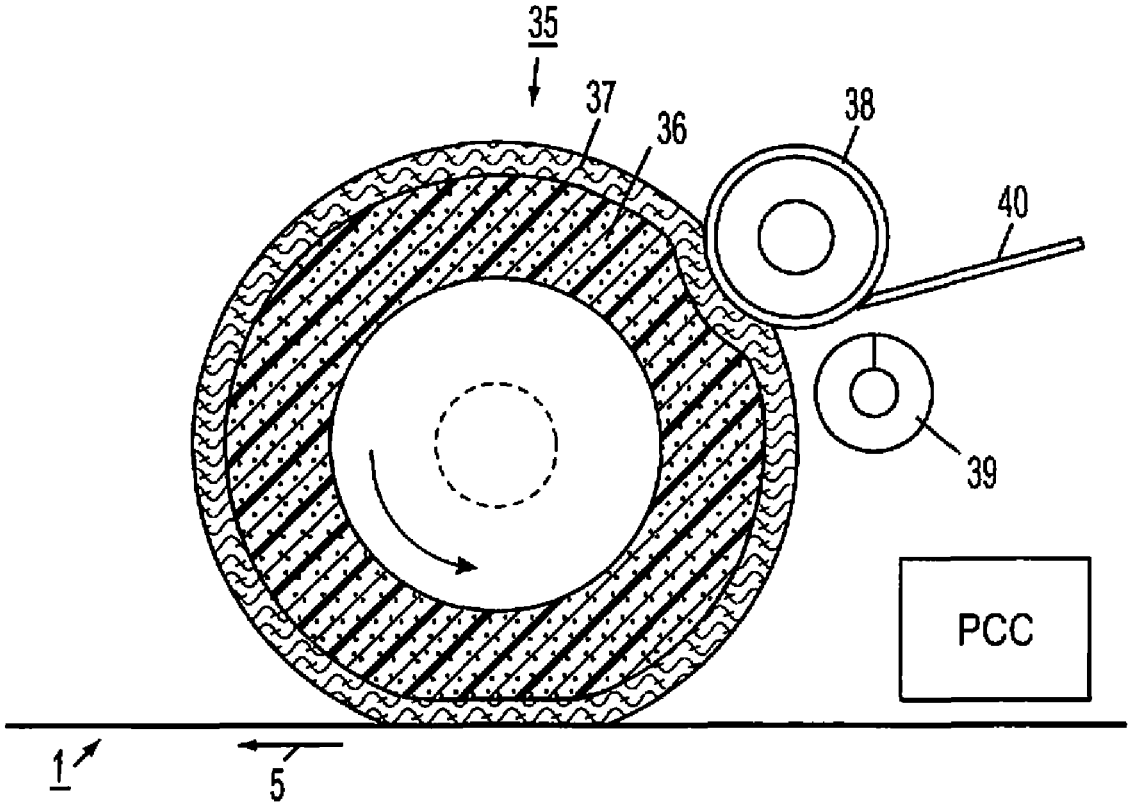
FIG. 2 illustrates an embodiment of the electrostatic roll cleaner of this invention.

In FIG. 2 the electrostatic roll cleaner 35 of this invention comprises a foam roll 36, a conductive fabric cleaning layer 37, an anodized detoning roll 38, a waste moving auger 39 and a cleaner blade 40. The roll cleaner 35 operates much the same as an electrostatic brush (ESB) cleaner 34 of the prior art. A preclean charging (PCC) device is required to adjust toner charge so that it can be cleaned efficiently by the biased electrostatic roll. The toner cleaned from the photoreceptor 1 by the conductive fabric 37 is transferred to the detoning roll 38, then scraped off detoning roll 38 by blade 40 where the toner falls into waste auger 39 for removal from the marking system. The conductive fabric used must be flexible and resilient, has preferably a flat, relatively smooth, uniform surface texture, that uniformly conforms to the cleaning and detoning surfaces. The roughness of the fabric should not exceed about 8 μm to 10 μm Ra (average roughness).

To illustrate that smooth surfaces are necessary, the following tests were conducted:

Equipment/Conditions: Five electrostatic rolls were tested with a range of textures from smooth to very rough. Roll foam cores 36 were fabricated as indicated with the fabric layers or coverings below. The fabric coverings for the five rolls were as shown in Table 3.

TABLE 3

Identification and description of ESR fabric coverings

| ESR No. | Covering Fabric | Texture Description |
|---|---|---|
| 1 | Zelt | Smooth plain weave |
| 2 | Shieldit Super | Smooth plain weave with ripstop |
| 3 | Stainless Steel Mesh | Very coarse open knit |
| 4 | Aluminum foil | Very smooth with some small wrinkles developed after use |
| 5 | Nickel mesh | Fairly fine mesh plain weave screen |

Procedure: The prototype rolls were mounted in a cleaner housing. A dual electrostatic brush cleaner was operated with an electrostatic roll of this invention in the first position, right sign toner cleaning (positive bias), and without a second cleaning brush or roll (1ESR cleaner). The test was performed in a paperless bench fixture, computer controlled for run length and toner patch development. A heavy cycle up stripe extended across the process width at the start of each job and a lighter stripe appeared at the end of each job. All development toner entered the cleaner with no transfer.

A standard test run was performed for each ESR type. Pairs of the largest full density toner patches were developed on each print panel. Fifteen of these toner patch pairs were developed and then the fixture allowed to cycle out. Then the machine was hardstopped after the development of six toner patch pairs. The hard stop location was programmed into the test fixture control computer to have the toner patch stopped partially through the cleaning nip. The print cartridge unit was removed from the fixture. The photoreceptor was rotated in the process direction to bring the toner patch into view. The computer controller was not totally repeatable in finding the location for the hardstop, so sometimes several hardstops were required to get the desired position. A tape transfer of the photoreceptor surface was taken to record toner on the surface before and after the ESR cleaning nip.

Results: Table 4 summarizes the cleaning performance of the five electrostatic rolls with a range of surface textures. Additional comments on each roll tested follow.

TABLE 4

Summary of ESR fabric coverings cleaning performance tests

| ESR No. | COVERING FABRIC | CLEANING | RANK | COMMENTS |
|---|---|---|---|---|
| 1 | Zelt | Good | 1 | Very good cleaning with a few streaks remaining |
| 2 | Shieldit Super | Good | 2 | Very good cleaning with remaining fabric texture streaks |
| 4 | Aluminum Foil | Poor | 3 | High mass removed, many streaks remaining |
| 5 | Nickel Mesh | Very poor | 4 | Very little cleaning |
| 3 | Stainless Steel Mesh | Very poor | 5 | Essentially no cleaning |

ESR 1—Zelt

Zelt fabric was the finest smooth plain weave of the conductive fabric samples obtained. Cleaning of the photoreceptor surface with this fabric was very good. The few streaks remaining were probably related to wrinkles in the fabric covering or low spots in the foam core. The toner streaks after the electrostatic cleaning roll tended to be seen in similar locations on each hardstop. This suggests that a defect in the uniformity of the roll exists in that location.

ESR2—Shieldit Super

The Shieldit Super roll cleaned quite well. The heavy input toner mass was generally removed. Some toner streaks remained that probably corresponded to defects in the handmade roll. There were also very fine streaks that corresponded to the rip stop pattern in the fabric. This result, along with the good performance of the fine weave Zelt fabric, suggests that very smooth texture is desirable.

ESR3—Stainless Steel Mesh

This material is a disaster as a cleaner. This is not unexpected since the open knit is not dense, but rather is very sparse. The tape transfer is almost as though the cleaner wasn't even there. White streaks through the toner image are due to cleaning by the sparse fiber loops of the fabric.

ESR4—Aluminum Foil

Aluminum foil covering for the ESR did remarkably well. The high mass of the toner input was mostly cleaned. Many fine streaks of toner did get past the cleaning roll. These are probably due to tiny wrinkles in the aluminum foil. The tiny wrinkles were generally created after the roll had been run in the fixture. Flexing of the foil when going through the cleaning and detoning nip seemed to have crinkled the surface. This result shows that a flexible and resilient material as well as smooth is needed for the ESR covering.

ESR—Nickel Mesh

The nickel mesh ESR covering did reasonably well. The cleaning was poor but better than might have been expected considering that the mesh is about twice as fine as ordinary window screen. The failures consisted of a high density of fine toner streaks. This suggests that the fabric has a fairly high cleaning capacity but that the weave isn't tight enough to handle the high toner input in this test. This conclusion would be consistent with early calculations comparing conductive fabric electrostatic cleaning to conductive fiber electrostatic cleaning. In this comparison, the conductive fabric had much higher cleaning capacity due to much higher surface contact than the brush fiber tips.

Figure 3:
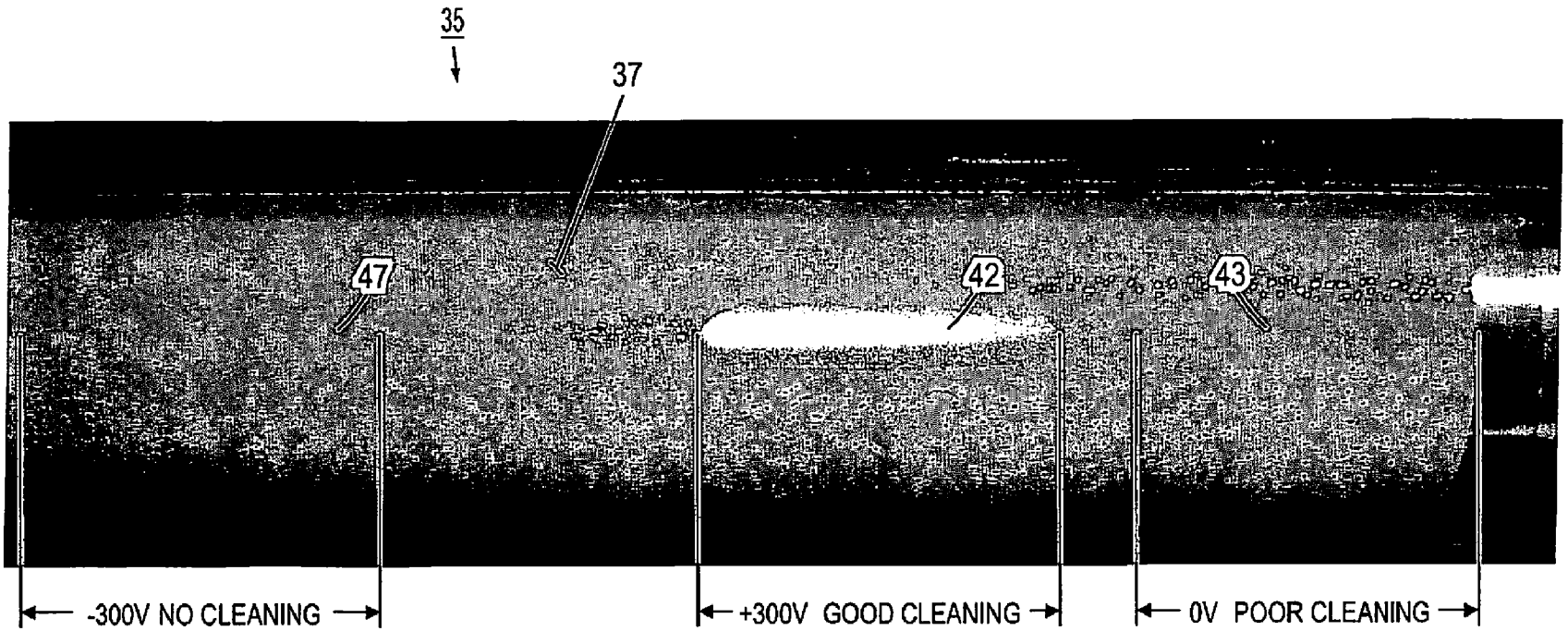
FIG. 3 illustrates the results of electrostatic cleaning of the photoreceptor surface using the roll cleaner of the present invention.

Preliminary experiments have been performed to demonstrate the cleaning function of a biased conductive fabric, as shown in FIG. 3. In these tests a conductive fabric 37 was mounted on a foam pad 36. The fabric-pad assembly 36-37 was then mounted to the bottom of a rigid piece of plastic with a 25 g weight mounted above the fabric-pad on the top side of the plastic. Toner was developed onto a single component photoreceptor drum. The weighted conductive fabric pad 36-37 was then pulled across the photoreceptor surface 1 with a range of electrical biases. The first test was with the fabric 37 and photoreceptor substrate 1 at the same potential, i.e. no electric field between the two, as shown at 47. The second test had the fabric biased 300 v more positive than the photoreceptor substrate 1. The majority of toner in contact with the fabric 37 was removed from the photoreceptor, as shown at 42. The last test biased the fabric 300 v more negative than the photoreceptor substrate 1. In this case toner was smeared by the fabric but very little toner was transferred from the photoreceptor 1 to the fabric, as shown at 43. These tests demonstrate that a biased conductive fabric 37 is capable of cleaning toner from the surface of a photoreceptor 1. Following the cleaning tests described above, electrostatic detoning of the positive biased fabric pad (that did a good job of cleaning) was attempted. The toner laden fabric pad was wiped across the surface of an anodized electrostatic detoning roll at the same three bias conditions used for the cleaning experiments. With no electric field between the conductive fabric and the electrostatic detoning roll core very little toner was transferred to the surface of the detoning roll. Less toner was transferred to the detoning roll when the detoning roll was biased 300 v more negative than the conductive fabric. A large amount of the toner on the conductive fabric was transferred to the detoning roll when the detoning roll was biased 300 v more positive than the conductive fabric.

This invention provides an electrostatic roll cleaner for use in cleaning a photoreceptor surface of a xerographic marking system. This roll cleaner comprises a compliant foam layer and a coating comprising a fabric overcoating said foam layer.

The fabric being woven, non-woven, braided or knit and preferably having a surface roughness not exceeding about 8 μm to 10 μm Ra (roughness average). The fabric, because of its shallow depth, is able to minimize toner accumulation therein. The fabric surface electrical resistivity may range between $3.5\times10^{-4}$ to $3.3\times10^{25}$ Ω/square. This range covers conductive fabrics ($3.5\times10^{-4}$ to $2.2\times10^{11}$ Ω/square) that must be actively biased through connection to a voltage source to non-conductive fabrics that are tribo-electrically charged by rubbing against contacting surfaces. As earlier noted, the yarns in the fabric must be of similar size to provide a smooth and uniform surface texture.

The foam layer comprises a material selected from the group consisting of polyurethanes, polycarbonates, polystyrenes and other polymeric foamable materials. The fabric preferably has a substantially flat, relatively smooth, uniform surface texture. The yarns used in constructing the fabric are preferably all the same or similar diameters and not a mixture of widely varying sizes. If the fabric is woven, for example, a balanced plain weave is preferred because the warp and weft yarns are of equal size. The fabric is configured to substantially conform to the cleaning and detoning photoreceptor surface being cleaned.

The roll cleaner is configured to clean a photoreceptor surface when the fabric is biased from 50 to 500 volts more positive than the bias on a photoreceptor surface when negative charged toner is used and to be cleaned off said photoreceptor. The opposite is true if positive charged toner is used. It is biased 50 to 500 volts more negative than the bias on the photoreceptor surface. Therefore, the roll cleaner is configured to clean a photoreceptor surface when the fabric is biased from 50 to 500 volts more negative than the bias on the photoreceptor surface when positive charged toner is used and to be cleaned off the photoreceptor.

The electrostatic roll cleaner system is used in cleaning toner from a photoreceptor surface. As noted above, the roll cleaner system comprises a cleaning roll comprising a conductive fabric overcoating a foam substrate and an anodized detoning roll. The conductive fabric has an average roughness, Ra, not exceeding about 8 μm to 10 μm and a surface resistivity in the range of $3.5\times10^{4}$ to $2.2\times10^{11}$ Ω/square.

The anodized detoning roll is in contact with the conductive fabric and is configured to remove toner from the conductive fabric for removal from the system. The detoning roll is configured to be biased at a higher voltage than a bias of the conductive fabric when cleaning the photoreceptor surface.

This invention also provides a cleaning station useful in a xerographic marking system. This station comprises an electrostatic roll cleaner, a detoning roll and an electrical connection to a biasing structure. Alternatively, the cleaning station may comprise two or more electrostatic roll cleaners, detoning rolls and electrical connections to biasing structures. The additional electrostatic roll cleaners may be biased to the same polarity or opposite polarity as the first electrostatic roll cleaner. The cleaning roll comprises a compliant foam layer overcoated with a conductive fabric overcoating. The fabric overcoating is configured to make cleaning contact with residual toner on a photoreceptor surface. The fabric has a substantially uniform, even and dense surface.

The biasing structure and the electrical connection in the station are configured to bias the fiber overcoating from about 50 to 500 volts more positive than a charge on the photoreceptor surface.

The station wherein the detoning roll is in cleaning contact with the fabric overcoating is configured to convey toner removed by it from the fabric overcoating to a location out of the station. The station is configured wherein the biasing structure is configured to bias the detoning roll to a higher positive voltage than the bias on the fabric overcoating.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrostatic roll cleaner for use in cleaning a surface of a xerographic marking system, said roll cleaner comprising:

a compliant foam layer, a coating comprising a conductive fabric overcoating said foam layer, said conductive fabric being woven, non-woven, braided or knit and having an average roughness, Ra, not exceeding about 8 μm to 10 μm and a surface resistivity in the range of $3.5\times10^{4}$ to $2.2\times10^{11}$ Ω/square, and said conductive fabric configured because of said average roughness able to minimize toner accumulation therein, said conductive fabric having yarns of similar size to provide thereby a smooth and uniform surface texture.

2. The roll cleaner of claim 1 wherein said foam layer comprises a material selected from the group consisting of polyurethanes, polycarbonates, polystyrenes and polymeric foamable materials.

3. The roll cleaner of claim 1 wherein said conductive fabric has a substantially flat, uniform, balanced plain weave.

4. The roll cleaner of claim 1 wherein said conductive fabric is of a substantially smooth texture and is configured to substantially conform to the surface being cleaned and a detoning roll surface used to remove toner from the conductive fabric.

5. The roll cleaner of claim 1 configured to clean a surface when said fabric is biased from 50 to 500 volts more positive than said surface when negative charged toner is used and to be cleaned off said surface.

6. The roll cleaner of claim 1 configured to clean a surface when said fabric is biased from 50 to 500 volts more negative than said surface when positive charged toner is used and to be cleaned off said surface.

7. An electrostatic roll cleaner system for use in cleaning toner from a surface, said roll cleaner system comprising:

a cleaning roll comprising a conductive fabric overcoating a foam substrate, and a detoning roll, said conductive fabric having an average roughness, Ra, not exceeding about 8 μm to 10 μm and a surface resistivity in the range of $3.5\times10^4$ to $2.2\times10^{11}$ Ω/square, and said detoning roll in contact with said conductive fabric and configured to remove toner from said conductive fabric for removal from said system said detoning roll configured to be biased at a higher voltage than a bias of said conductive fabric when cleaning said surface.

8. The roll cleaner of claim 7 wherein said foam substrate comprises a material selected from the group consisting of polyurethanes, polycarbonates, polystyrenes and polymeric foamable materials.

9. The roll cleaner of claim 7 wherein said conductive fabric has a substantially flat, uniform, balanced plain weave.

10. The roll cleaner of claim 7 wherein said conductive fabric is of a substantially smooth texture and is configured to substantially conform to the surface being cleaned and the detoning roll surface used to remove toner from the conductive fabric.

11. The roll cleaner of claim 7 configured to clean a surface when said fabric is biased from 50 to 500 volts more negative than said surface when positive charged toner is used and to be cleaned off said surface.

12. A cleaning station useful in a xerographic marking system comprising:

an electrostatic roll cleaner a detoning roll, and an electrical connection to a biasing structure, said cleaning roll comprising:

a compliant foam layer overcoated with a conductive fabric overcoating, said conductive fabric being woven, non-woven, braided or knit and having an average roughness, Ra, not exceeding about 8 μm to 10 μm and a surface resistivity in the range of $3.5\times10^4$ to $2.2\times10^{11}$ Ω/square, said conductive fabric configured because of said average roughness able to minimize toner accumulation therein, said conductive fabric having yarns of similar size to provide thereby a smooth and uniform surface texture; and said biasing structure and said electrical connection configured to bias said fiber overcoating from about 50-500 volts more positive than a charge on said surface.

13. The station of claim 12 wherein said detoning roll is in cleaning contact with said fabric overcoating and configured to convey toner removed by it from said fabric overcoating to a location out of said station.

14. The station of claim 12 wherein said biasing structure is configured to bias said detoning roll to a higher positive voltage than said bias on said fabric overcoating.

* * * * *